US005196834A

United States Patent [19]

Edelson et al.

[11] Patent Number: 5,196,834

[45] Date of Patent: Mar. 23, 1993

[54] DYNAMIC PALETTE LOADING OPCODE SYSTEM FOR PIXEL BASED DISPLAY

[75] Inventors: Steven D. Edelson, Wayland; Marc Norvig, Allston, both of Mass.

[73] Assignee: Analog Devices, Inc., Norwood, Mass.

[21] Appl. No.: 452,422

[22] Filed: Dec. 19, 1989

[51] Int. Cl.[5] ..... G09A 1/28

[52] U.S. Cl. ..... 340/703; 340/701

[58] Field of Search ..... 340/701, 703, 747, 448, 340/811, 798, 799, 750; 358/28

[56] References Cited

U.S. PATENT DOCUMENTS

| | | | |
|---|---|---|---|
| 4,233,601 | 11/1980 | Hankin et al. | 340/750 |
| 4,509,043 | 4/1985 | Mossaides | 340/703 |
| 4,591,842 | 3/1986 | Clarke, Jr. et al. | 340/723 |
| 4,704,605 | 4/1987 | Edelson | 340/728 |
| 4,791,580 | 2/1988 | Sherrill et al. | 364/521 |
| 4,799,053 | 1/1989 | Van Aken et al. | 340/703 |
| 4,823,120 | 1/1989 | Thompson et al. | 340/703 |
| 4,868,554 | 9/1989 | Aoki et al. | 340/748 |

*Primary Examiner*—Ulysses Weldon
*Assistant Examiner*—Regina Liang
*Attorney, Agent, or Firm*—Lane, Aitken & McCann

[57] ABSTRACT

In a pixel based color display system, a pixel responsive control is provided for high speed loading of new colors in the random access memory of the system used as a look-up table. In the system, pixel words representing addresses in a random access memory in which colors to be displayed are stored are applied in sequence to the random access memory to cause the colors to be read out in sequence to generate red, green and blue video signals representing the colors read out from the random access memory. The pixel responsive control responds to a predetermined pixel word in the stream of pixel words applied to the address port of the random access memory to cause a new color to be stored in a selected storage location of the random access memory. The new color and the address in which the new color is to be stored is specified in the pixel words immediately following the predetermined pixel word.

9 Claims, 3 Drawing Sheets

DYNAMIC PALETTE LOADING OPCODE SYSTEM FOR PIXEL BASED DISPLAY

BACKGROUND OF THE INVENTION

This invention relates to a pixel based display system in which different colors to be displayed are stored in the random access look-up table memory and, more particularly, to a pixel based display system in which the number of colors which can be displayed by the system is increased without increasing the size of the random access memory storing the colors.

In pixel based display systems, the screen is divided into tiny areas called pixels which are individually colored to make a composite multi-colored image. State-of-the-art pixel based display systems employ a look-up table or random access memory, called the palette RAM, to store different colors to be displayed in different pixels of an image. To generate a color image, pixel words, each corresponding to a pixel of an image to be displayed and representing an address of the palette RAM, are fed in sequence to the palette RAM to read out the colors from the RAM locations. The colors may be stored as color intensity values, which represent red, green, and blue intensities. Alternatively, the colors may be stored as values representing hue, saturation, and brightness or in the YIQ color representation system. When a color is read out from a RAM location, the values representing the color are fed to analog-to-digital converters which convert the intensity values to analog signals. The resulting analog signals are applied to a display device to generate the color image.

Personal computers typically employ palette RAMS having sixteen storage locations selectable by four-bit pixel words or having 256 storage locations selectable by eight-bit pixel words. Since the colors are controlled by the values stored in the locations of the palette RAM, the colors in a given image can be varied simply by storing new color values in the storage locations. For this purpose, an I/O channel is provided to load new colors into the palette RAM. The number of colors which can be displayed in a based image is limited by the number of different storage locations in the palette RAM and it is often desirable to be able to display more colors than is permitted by the number of storage locations in the palette RAM. For example, complex photographs may require as many as 50,000 different colors. The conventional solution to the problem of providing more colors is to provide a larger palette RAM with a greater number of storage locations. Software can be used to increase the number of apparent colors by dithering, in which in-between shades of color are created by making patterns of the colors which are available. For example, if dark blue and white were available, a light blue area can be simulated with blue dots on a field of white. In this manner, an illusion of light blue is achieved. This method of showing additional colors is effective for large areas, but the quality of such a system does not equal having the color light blue itself stored in the palette RAM. Moreover, dithering cannot show small details and it cannot represent different shades of light blue satisfactorily.

The present invention increases the number of colors available that can be used in a given image by taking advantage of the fact that colors used at one place in the screen are frequently not needed at another place in the screen. For example, different colors may be used at the top of the screen than at the bottom. If there is a blue sky being displayed at the top of the screen and green grass is displayed at the bottom of the screen, different shades of blue may be needed at the top of the screen and different shades of green needed at the bottom of the screen. It would be advantageous, therefore, to reload the palette RAM with blue colors whenever the top of the screen display is being generated and replace these blue colors with green at the bottom of the screen.

The color stored in the palette RAM can be changed at any time by loading new colors through an I/O channel. If the system software could keep track of where on the screen a video display is currently being generated and could reload the palette quickly and not interfere with the image while the palette RAM was being loaded, it could change the stored colors in the middle of an image and thus make possible the display of many more colors on the screen with the same size palette RAM. Such a system, however, is not practical because the video display scans very rapidly across the display screen and it is very difficult for the software to know where on the screen the display is currently being generated. Moreover, the I/O channel operates relatively slowly. It normally takes a time interval corresponding to 25 to 100 pixels for the system to load one new color in the palette RAM via the I/O channel. Moreover, to keep even an approximate track of the position of the display on the screen requires an extensive software effort and if the software is keeping track of the display on the screen, then the software has little time to do anything else, such as serving the keyboard, responding to interrupts, etc. In addition to these problems, when the processor loads a new color in the RAM in the middle of an image, it causes indeterminate colors to be generated during the loading resulting in the image distortion commonly described as snow. Such distortion occurs because the palette ram cannot be read out by pixel words being received at the video port while the new colors are being loaded into the pixel RAM via the I/O channel. Such snow can be avoided to some extent by limiting the storage of new colors in the palette RAM during the intervals of vertical and horizontal retraces in the video display system, but this would require the software to keep precise track of where in the raster scan the display is currently being generated.

SUMMARY OF THE INVENTION

The system of the present invention makes it possible to display a given image with more colors than are permitted by the number of storage locations in the palette RAM by storing new colors in the middle of an image, but without the disadvantages described above. In accordance with the present invention, the new colors are loaded into the RAM by means of the pixel words applied to the video port of the pixel decoder palette rather than through the I/O channel. In accordance with the invention, one pixel word value is selected to be the key color code. Whenever this pixel word is applied to the video port of the system, the presence of the word is detected. The next three pixel words following the key color code are the values representing the new color to be stored in the palette RAM. These three pixel words are then followed by a pixel word which represents the palette address in which the new color is to be stored. In response to receiving the key color code, the system of the present invention stores new color values in the palette address represented in the fourth pixel word following the key color code. Accordingly, before the key color code appears in the pixel word sequence, the color that was previously stored in the selected address location can be displayed and after the key color code in the pixel word sequence, the new color stored in the selected address can be displayed. To prevent snow or noise appearing on the screen while the new color is being loaded into the palette RAM in this manner, the color which is being generated in the pixel display immediately prior to the point at which the key color code appears in the sequence is caused to be displayed by the video display device throughout the five pixel words of the key color code sequence. The storing of a new color in the palette RAM can be carried out several times during the raster scan of an image. Most images have many areas of constant color which allows a large number of opportunities to reload the palette with new colors throughout the image generation. In this manner, the number of colors which can be displayed in a given image is substantially increased.

DESCRIPTION OF THE PREFERRED EMBODIMENT

Figure 1:
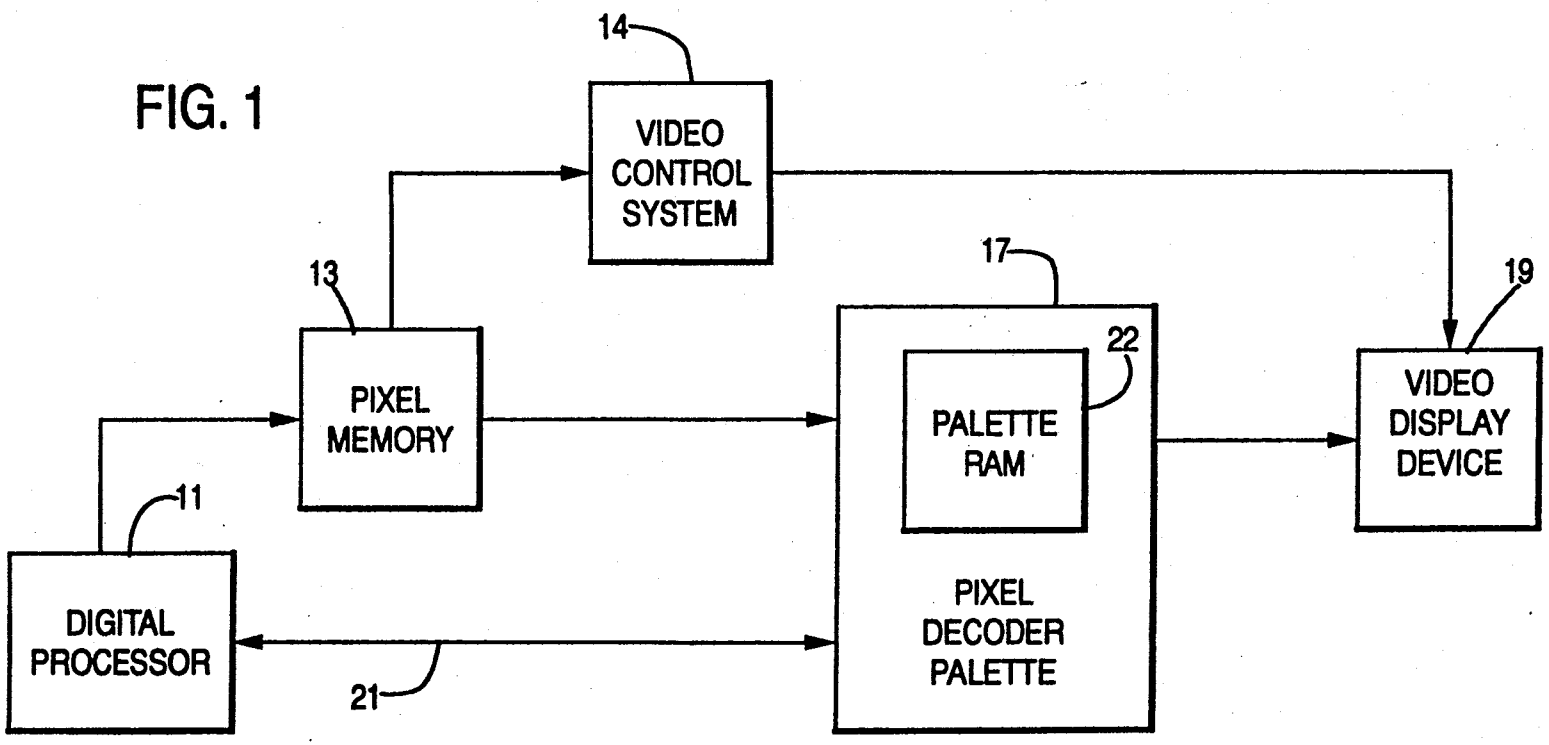
FIG. 1 is a block diagram illustrating a pixel based display system in which the system of the present invention is employed.

In the system of the invention as shown in FIG. 1, a digital processor 11 generates display data in the form of pixel words which are stored in a pixel memory 13. The pixel memory 13 stores pixel words representing a set of pixels of an entire a video frame to be displayed. In a conventional pixel display system, each pixel word stored in the pixel memory will control the color of a corresponding displayed pixel in the frame to be displayed. A video control system 14 reads the pixel words stored in the pixel memory 13 in sequence and applies them to the video port of a pixel decoder palette 17. The video control system 14 applies video scanning signals directly to a video display device 19 in synchronism with the pixel words as they are read out of pixel memory 13. In response to the applied pixel words, the pixel decoder palette generates red, green and blue video signals, which are applied to the video display device 19, which reproduces the image represented by the pixel words stored in the pixel memory.

In a conventional pixel word display system, each pixel word applied to the pixel decoder palette will represent an address in a random access memory 22, called the palette RAM, in the pixel decoder palette. The different memory locations in the palette RAM are each capable of storing data representing a color. A color is stored in a memory location in the random access memory in the form of three bytes, which typically consist of 6, 8, or 10 bits. In one system of color representation, one byte represents the intensity of the color red, a second byte represents the intensity of the color green and the third byte represents the intensity of the color blue. The specific embodiment of the present invention is described as employing the red, blue and green intensity value system of representing color. However, the invention is equally applicable to other known color representation systems such as representing color by hue, saturation and brightness or by the YIQ system.

When a pixel word is applied to the video port of the pixel decoder palette, this action causes a corresponding memory location in the random access memory 22 to be read out and the color bytes are applied to digital-to-analog converters. The digital-to-analog converters convert the applied bytes to analog signals, which are the red, green and blue video signals applied to the video display device 19.

With the system described above, the color of a component in the displayed image may be changed by changing the data in a memory location in the palette RAM. For purposes of making such changes, the processor 11 can communicate with the pixel decoder palette via the I/O channel 21 and is operable to store new colors in the palette RAM 22 to thereby change colors of different components in the image being displayed in response to the pixel words stored in the pixel memory 13. However, as explained above, it is not practical to use I/O channel 21 to attempt to repeatedly change colors during the scan of a given image so that more colors can be displayed in a given image than there are address location in the palette RAM 22.

In accordance with the present invention, the pixel decoder palette 17 is provided with the capability of responding to a pixel word consisting of a predetermined address supplied in the pixel word sequence from the pixel memory 13 to the video port of the pixel decoder palette 17. This predetermined address is called the key color code. In the specific embodiment of the present invention, the key color code is address 191 in the palette RAM 22 and whenever the pixel decoder 17 detects the presence of this pixel word, it responds to the next four pixel words following this pixel word to store a new color in the palette RAM 22. The new color is that specified in the next three pixel words following the key color code and the new color is stored at the address location specified in the fourth pixel word following the key color code. The first pixel word following the key color code will be the red intensity to be stored at the selected address location. The second pixel word following the color code key will be the green intensity and the third pixel word following the key color code will be the blue intensity.

Figure 2:
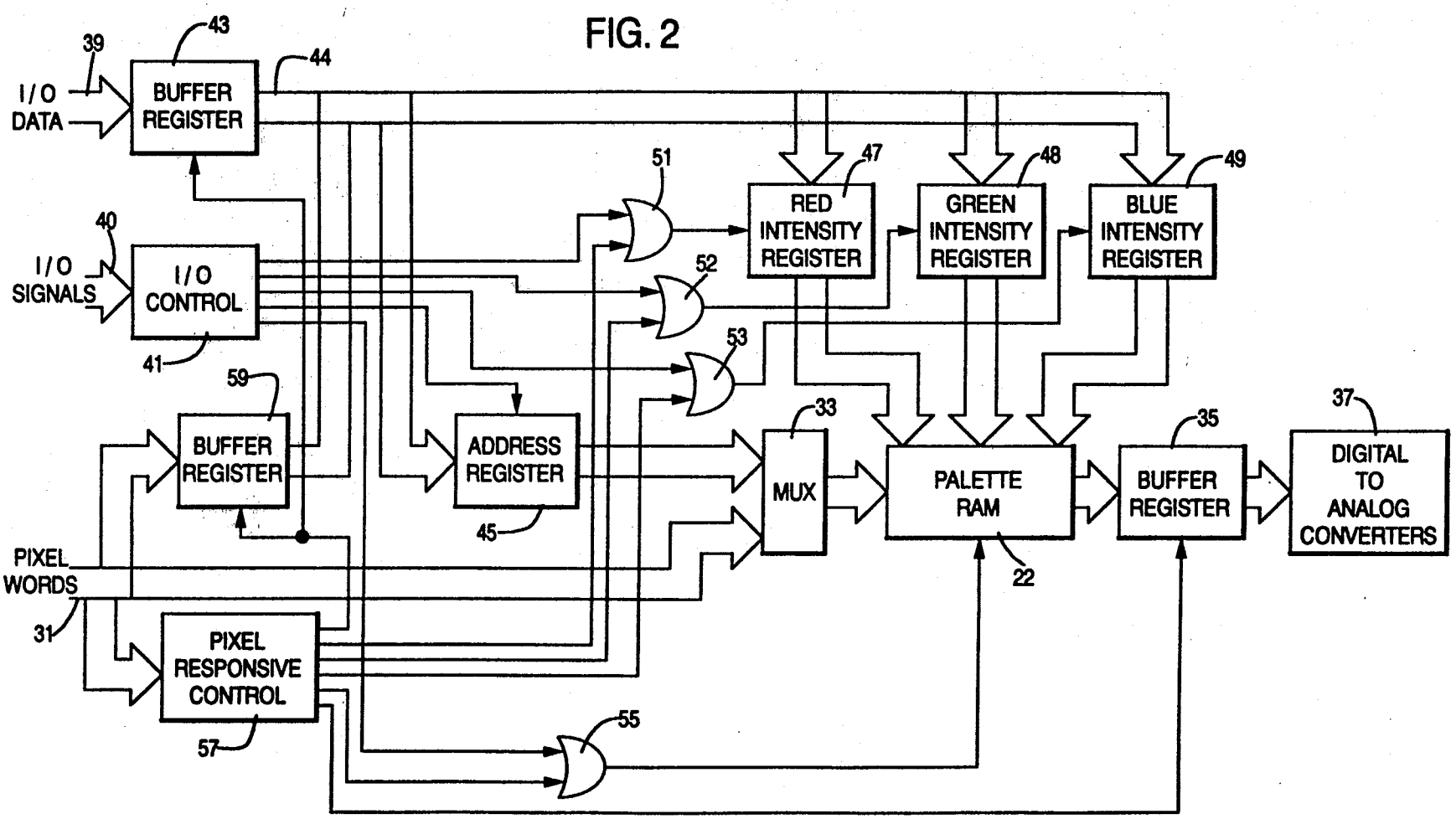
FIG. 2 is a block diagram illustrating the pixel decoder palette of the system of the present invention.

As shown in FIG. 2, 8-bit pixel words are received by the palette decoder at the video port on pixel channel 31. In normal pixel display operations, the pixel words on channel 31 are applied through a multiplexer 33 to the palette RAM 22 to cause the palette RAM to read out red, green and blue intensity values to a buffer register 35 which applies the intensity values to digital-to-analog converters 37. The digital-to-analog converters 37 convert the intensity values to red, green and blue video signals which are applied to the video display device. The I/O channel comprises an 8-bit data channel 39 and a control signal channel 40, which is connected to an I/O control 41. When it is desired to store a new color in a selected palette RAM address by the I/O channel, first the address in the palette RAM 22 into which the new color is to be stored is transmitted on the data channel 39 along with the appropriate I/O control signals applied to the I/O control 41 over signal channel 40. The I/O control signals indicate that the word received on the data channel is an address for color values to be stored in the palette RAM 22. The address received on the I/O data channel 39 will be stored in a buffer register 43 which will be normally enabled to apply the address signals over a data bus 44 to an address register 45. The address register 45 will be enabled to receive and store the address received over the data bus 44 by the I/O control 41 in response to the I/O control signals on signal channel 40 received with the address. When a new color is being stored in the RAM 22, the address on the data channel 39 will be followed by the red, green and blue intensity values to be stored in the selected storage location. Each of the red, green and blue intensity values will be accompanied by appropriate I/O control signals on the control signal channel 40 indicating that the accompanying bits received on the data channel 39 represent color values to be stored in the palette RAM 22. Each color intensity value received on data channel 39 will be received in the buffer 43 and applied to the data bus 44, which transmits the color values to the color intensity registers 47, 48 and 49. I/O control 41, in response to receiving the control signals on channel 40 accompanying the red intensity value, will apply an enabling signal through an OR gate 51 to cause the red intensity value to be stored in the red intensity register 47. Then, when the green intensity value is applied to the data bus 44 by the buffer 43, the I/O control 41, in response to the control signals on channel 40 accompanying the green intensity value on the data channel 39 will apply an enabling signal through an OR gate 52 to the green intensity register 48 and cause the green intensity value to be stored in the register 48. Then, when the buffer 43 applies the blue intensity value to the data bus 44, the I/O control 41 in response to the control signals on channel 40 accompanying the blue intensity value on the data channel 39 will apply an enabling signal through an OR gate 53 to the blue intensity register 49 and cause the blue intensity value to be stored in the register 49. Following the storing of the blue intensity value in the blue intensity register 49, the I/O control 41 will automatically apply a signal to the multiplexer 33 to switch the multiplexer 33 to apply the address value stored in the register 45 to the address input of the palette RAM 22 and, at the same time, the I/O control 41 will apply a triggering signal through an OR gate 55 to the RAM 22. In response to the triggering signal, the RAM 22 will store the intensity values applied to the RAM 22 from the registers 47 through 49 in the storage location selected by the address applied to the RAM 22 from the multiplexer 33. In this manner, the pixel decoder palette operates to store a new color in a selected storage location in response to the data received over the I/O channel. The I/O control 41, in responding to the control signals on channel 40 to steer the address on the data channel 39 to the address register 45 and from the address register 45 through the multiplexer 33 to the address port of the palette RAM 22 and to steer the color bytes to the red, green and blue intensity registers 47, 48 and 49 and cause these intensities to be stored in the palette RAM 22, functions in essentially the same manner as the prior art pixel based display systems.

In accordance with the present invention, the key color code representing address 191 received in the stream of pixel words applied on the pixel channel 31 is an indication that a new color is to be stored in the palette RAM in response to data coming over the pixel channel 31. The pixel words received on the pixel word channel 31 are applied to a pixel responsive control 57, which detects the presence of the key color code address 191 on the pixel channel 31. The pixel words received on the pixel channel 31 are also applied to a buffer register 59 where they are registered in sequence as they are received. The pixel responsive control 57,.in response to receiving the key color code on the pixel channel 31, will enable the buffer register 59 to apply the pixel word stored thereby to the data bus 44 at the time the next pixel word is received and stored in buffer register 59. As explained above, the pixel word following the key color code on the pixel channel 31 will represent the red intensity value to be stored in the new selected storage location by the pixel data. At the same time the pixel responsive control 57 enables the buffer register 59 to apply its contents to the data bus 44, the pixel responsive control 57 will also apply an enabling signal through the OR gate 51 to the red intensity register 47 and cause the value on data bus 44 to be stored in the register 47. In this manner, the red intensity value following the key color code is stored in the red intensity register 47. Then, when the green and blue intensity values following successively behind the red intensity value are stored in the register 59, the pixel responsive control 57 will enable the buffer register 59 to apply these values in succession to the data bus 44 and will apply enabling signals through the OR gates 52 and 53 to enable the green and blue intensity registers 48 and 49 to receive and store the green and blue intensity values. In this manner, the registers 47 through 49 are caused to store the red, green and blue intensity values received on the pixel channel 31 following the key color code. Following the green and blue intensity values on the pixel channel 31, the address of the storage location into which the new color is to be stored is received on the pixel channel 31. When this word is received, it will pass through the multiplexer 33 in its normal state to the input of the RAM 22. While this address is being applied, the pixel responsive control 57 will apply an enabling signal through the OR gate 55 to trigger the RAM 22 to store the intensity values applied to the RAM 22 from the registers 47 through 49 in the storage location selected by the address received from the multiplexer 33. The pixel responsive control 57 in response to receiving the key color code, also applies a hold signal to the buffer register 35 to cause it to retain the previous intensity values received in the register 35 from the palette RAM 22 in response to the pixel word received by the palette RAM 22 preceding the key color code. The buffer register 35 is caused to retain these previously received intensity values for the pixel corresponding to the key color code and for the next four succeeding pixel words following the key color code so that the digital-to-analog converters 37 will continue to produce output color video signals corresponding to the color read out from the palette RAM 22 immediately preceding the key color code while the new color is being stored in the palette RAM 22. In the manner described above, a new color is stored in the palette RAM 22 in response to the pixel data at the high pixel data rate.

Figure 3:
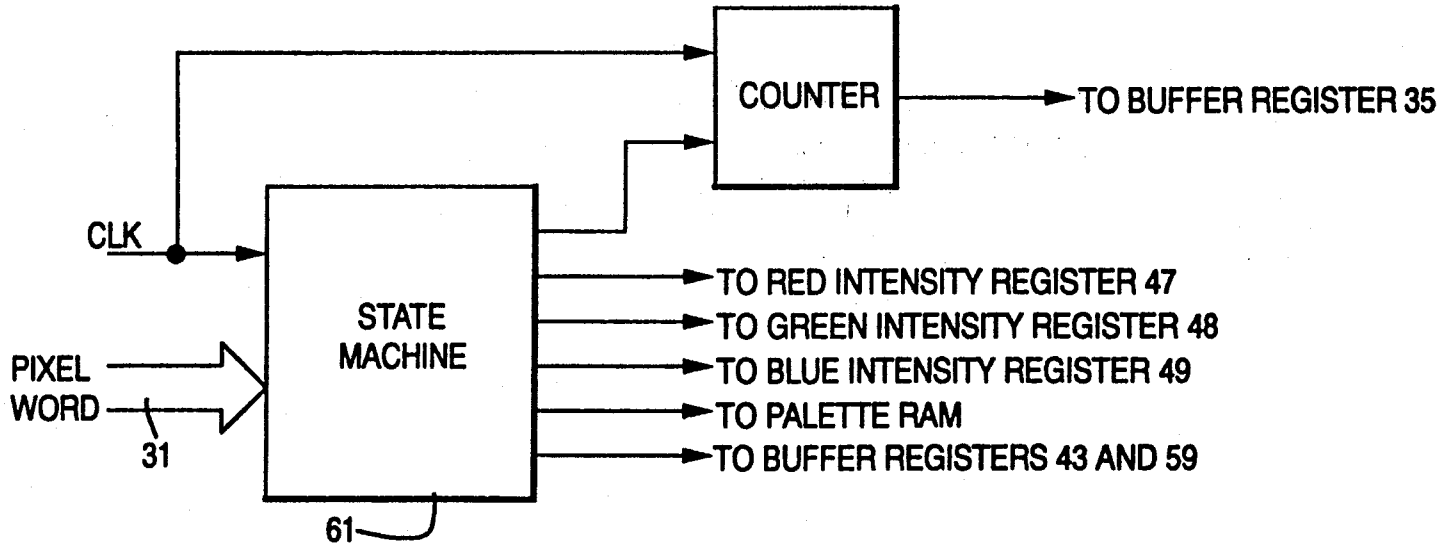
FIG. 3 is a block diagram illustrating details of the pixel responsive control employed in the pixel decoder palette shown in FIG. 2.

As shown in FIG. 3, the pixel responsive control 57 comprises a state machine 61 connected to receive the pixel words on pixel channel 31 as well as the pixel clock signal received on signal line CLK and accompanying each pixel word. The state machine 61 is implemented by a programmable logic array and flip-flop circuit which, based on various logic inputs, advances through a sequence of states which are represented by the condition of the output flip-flops. Upon the system powering up, the state machine 61 is set in an idle state.

When the state machine 61 is in the idle state and receives the key color code on the pixel channel 31, it will be advanced to its red state. In its red state, the state machine 61 produces an output signal to enable the buffer register 59 to apply its contents to the data bus 44 and disable the buffer register 43. At the same time the state machine 61 will produce an output enabling signal that is applied through the OR gate 51 to the red intensity register 47. By the time the state machine has switched to its red state and applied the enabling signals to the buffer register 59 and the red intensity register 47, the red intensity value of the new color to be stored following the key color code on the pixel word channel 31 will be received in buffer register 59. Accordingly, this red intensity value will be stored in the red intensity register 47. In response to the clock pulse accompanying the red intensity value following the key color word, the state machine 61 is advanced to its green state. In its green state, the state machine 61 applies an enabling signal to the buffer register 59 and disables the buffer register 43 so that the green intensity value in the next pixel word on channel 31, upon being stored in the buffer register 59 is applied to the data bus 44. At the same time, the state machine 61, while in its green state, will apply an enabling signal through the OR gate 52 to the green intensity register 48. As a result, when the green intensity value is applied to the data bus 44 by the buffer register 59, it will be stored in the green intensity register 48. In response to the clock pulse accompanying the green intensity value on the channel 31, the state machine 61 will be advanced to its blue state. In its blue state, the state machine 61 will again apply an enabling signal to the buffer register 59 and a disabling signal to the buffer register 43 so that the blue intensity value in the next pixel word applied on channel 31, upon being stored in the buffer register 59, is applied to the data bus 44. The state machine 61, while in the blue state, will also apply an enabling signal through the OR gate 53 to the blue intensity register 49 so that the blue intensity value applied to the data bus 44 will be stored in the register 49. In response to the clock pulse accompanying the blue intensity value on the pixel channel 31, the state machine 61 will be advanced to its address state. In the address state, the state machine 61 will apply an enabling signal through the OR gate 55 to the palette RAM 22 to cause it to store the intensity values stored in the registers 47, 48 and 49 at the address location which is applied to the palette RAM through the multiplexer 33. This address will be the address in the next pixel word following the blue intensity value on the pixel word channel 31. In response to the clock pulse accompanying this next pixel word, which is the fourth pixel word following the key color code, the state machine 61 will be advanced to its hold state. If the next pixel word following the fourth pixel word after the key color code is the key color code again, the state machine will be returned from its hold state to its red state and the sequence will be repeated to store another new color in another specified address. If the next pixel word is not the key color code, then in response to the clock pulse accompanying this pixel word, the state machine 61 will be returned to its idle state.

When the state machine is advanced to its red state, it also applies a signal to a counter 63 to set the counter 63. The counter upon being set produces an output signal, which is the hold, signal applied to the register 35, to cause it to retain in storage the last color read out from the palette RAM in response to last pixel word received prior to the key color code. The clock pulses accompanying the pixel words are applied to the counter 63 which after being set will count the clock pulses. After being set by the output signal from the state machine 61, the counter 63 will count four clock pulses and on the fifth clock pulse received after being sent will be returned to its idle state and remove the hold signal from the buffer register 35. Accordingly, if the fifth pixel word following the key color code is an address in the RAM other than 191, that is, is not the key color code, the color intensity values read out from the palette RAM 22 will be stored in the buffer register 35. On the other hand, if the fifth pixel word following the key color code is a repeat of the key color code, the state machine 61 will again set the counter 63 so that the counter 63 will again produce the hold signal applied to the buffer register 35 to cause it to hold the previously read out color in the register 35 for four more clock pulses.

In the above described system, colors stored in the RAM 22 can be changed in response to the pixel words being received on the pixel channel 31. The particular technique employed is the use of a predetermined pixel word which comprises a key color code and the system responds to this key color code to then make use of a sequence of pixel words following the key color code to carry out the function of storing a new color in the RAM 22. In this manner, colors may be changed in the RAM 22 as an image is being generated by the pixels in the output display device or, in other words, while the image is being scanned by the raster scan signals.

This technique of using a selected pixel word value like the key color code can be used to cause the pixel decoder palette to carry out other functions. For example, a selected pixel word value could be used to cause the pixel decoder palette to switch to a different mode of operation. Another mode of operation of the pixel palette could be to operate on color intensity values in the form of 4-bit or 6-bit bytes instead of 8-bit bytes so that the system could be used with software in which the color intensity values are represented in 4-bit or 6-bit bytes instead of 8-bit bytes. Alternatively, a selected pixel word value could cause the system to switch into a edge smoothing mode of operation wherein the edges between pixels are averaged in the manner disclosed in U.S. Pat. No. 4,704,605 invented by a coinventor of this application. The pixel word values which cause different functions to be carried out are called "opcodes" and the key color code to trigger the storing of a new color in the pixel memory could be just one of several opcodes that can be used for a number of different functions. In a conventional display system, the only function of a pixel word applied to a pixel decoder palette is to read out a color to be displayed from the palette RAM. In the edge smoothing system disclosed in U.S. Pat. No. 4,704,605, a pixel word applied to the pixel display system is sometimes used to determine the amounts of color from each side of a boundary to be mixed in a pixel bridging the boundary. In accordance with the present invention, a pixel word, comprising an opcode, can be used to trigger any selected function designed into the system.

With a conventional pixel memory 13 and video control system 14, the pixel words applied to video port of the pixel decoder palette will each correspond to pixels to be displayed and no pixel words are sent out from the pixel memory 13 and applied to the video port of the pixel decoder palette during the horizontal and vertical blanking signals generated by the video control system 14. The pixel memory 13 and the video control system 14 could readily be modified to apply pixel words representing a key color code sequence or other opcodes to the video port during the time of the horizontal and vertical blanking signals so that the opcodes do not cause any interference with the picture being generated.

These and other modifications may be made to the above-described specific embodiment of the invention without departing from the spirit and scope of the invention which is defined in the appended claims.

We claim:

1. In a color pixel display system comprising a palette random access memory having a multiplicity of storage locations, each capable of storing a value representing a color to be displayed, means to apply pixel words in sequence to said palette random access memory, said palette random access memory having means to read out values from memory locations selected by said pixel words, and means to generate a pixel based color display in accordance with the values read out from said palette random access memory, the improvement comprising pixel control means responsive to a predetermined pixel word in the sequence of pixel words applied to said palette random access memory to cause a new color to be stored in said palette random access memory at a selected address location, wherein the new color stored by said pixel control means is specified in the pixel words immediately following said predetermined pixel word in said sequence of pixel words.

2. In a color pixel display system comprising a palette random access memory having a multiplicity of storage locations, each capable of storing a value representing a color to be displayed, means to apply pixel words in sequence to said palette random access memory, said palette random access memory having means to read out vales from memory locations selected by said pixel words, and means to generate a pixel based color display in accordance with the values read out from said palette random access memory, the improvement comprising pixel control means responsive to a predetermined pixel word in the sequence of pixel words applied to said palette random access memory to cause a new color to be stored in said palette random access memory at a selected address location, wherein said pixel control means stores the new color in an address location selected by one of a plurality of pixel words which immediately follow said predetermined pixel word in said sequence.

3. In a pixel display system as recited in claim 2, wherein said plurality of pixel words following said predetermined pixel word in said sequence include pixel words representing color intensity values of the new color to be stored in said palette random access memory.

4. In a pixel display system as recited in claim 3, wherein the first three pixel words in said sequence following said predetermined pixel word specify color intensity values of the new color to be stored in said palette random access memory and the fourth pixel word following said predetermined pixel word specifies the address location in which the new color is to be stored.

5. In a color pixel display system comprising a palette random access memory having a multiplicity of storage locations, each capable of storing a value representing a color to be displayed, means to apply pixel words in sequence to said palette random access memory, said palette random access memory having means to read out values from memory locations selected by said pixel words, and means to generate a pixel based color display in accordance with the values read out from said palette random access memory, the improvement comprising pixel control means responsive to a predetermined pixel word in the sequence of pixel words applied to said palette random access memory to cause a new color to be stored in said palette random access memory at a selected address location, and buffer means to maintain the color in the pixels being generated in the pixel display the same as the previously generated pixels while said new color is being stored in said palette random access memory.

6. In a pixel display system as recited in claim 5, wherein said buffer means comprises a buffer register to store digital values representing the color read out from said palette random access memory and means to maintain the digital values stored in said buffer register during the time that said new color is being stored in said palette random access memory.

7. In a pixel display system comprising a random access memory having a multiplicity of storage locations, each capable of storing a value representing a color to be displayed, means to apply pixel words in sequence to said random access memory to read out values from the memory locations selected by said pixel words, and means to generate a pixel based display in accordance with the values read out from said random access memory, the improvement comprising pixel word responsive control means separate from said random access memory and responsive to a predetermined pixel word in the sequence of pixel words applied to said palette random access memory to perform a predetermined function different than reading out a color from said random access memory and different than controlling the mixing of colors in a predetermined pixel, wherein said predetermined function is controlled by at least one pixel word immediately succeeding said predetermined pixel word.

8. In a pixel based display system as recited in claim 7, further comprising means to cause the colors displayed in adjacent pixels in said pixel based display corresponding to said predetermined pixel word and a pixel word immediately succeeding said predetermined pixel word to be the same.

9. In a pixel based display system as recited in claim 7, wherein means are provided to cause the pixel in said pixel based display corresponding to said predetermined pixel word to have the same color as an immediately preceding pixel in said pixel based display.

* * * * *